US008610010B2

(12) United States Patent
Karch et al.

(10) Patent No.: US 8,610,010 B2
(45) Date of Patent: Dec. 17, 2013

(54) CONTROL ELEMENT FOR A MOTOR VEHICLE

(75) Inventors: Michael Karch, Burglauer (DE); Stefan Schuberth, Bad Neustadt (DE)

(73) Assignee: Preh GmbH (DE)

( * ) Notice: Subject to any disclaimer, the term of this patent is extended or adjusted under 35 U.S.C. 154(b) by 934 days.

(21) Appl. No.: 12/531,641

(22) PCT Filed: Mar. 17, 2008

(86) PCT No.: PCT/EP2008/002115

§ 371 (c)(1),
(2), (4) Date: Feb. 16, 2010

(87) PCT Pub. No.: WO2008/113544

PCT Pub. Date: Sep. 25, 2008

(65) Prior Publication Data

US 2011/0120249 A1 May 26, 2011

(30) Foreign Application Priority Data

Mar. 17, 2007 (DE) ..... 10 2007 012 863

(51) Int. Cl.
*H01H 19/00* (2006.01)

(52) U.S. Cl.
USPC ..... 200/7

(58) Field of Classification Search
USPC ..... 200/7, 6 R, 6 A, 335, 4, 5 R, 11 R, 14, 200/16 R, 17 R, 18, 336, 341, 345, 61.08, 200/300, 334, 570, 571, 564; 74/471 XY
See application file for complete search history.

(56) References Cited

U.S. PATENT DOCUMENTS

| | | | | |
|---|---|---|---|---|
| 2,240,498 | A * | 5/1941 | Elliott | 307/141.8 |
| 4,590,339 | A * | 5/1986 | Scott-Jackson et al. | 200/6 A |
| 5,228,356 | A * | 7/1993 | Chuang | 74/471 XY |
| 6,201,196 | B1 * | 3/2001 | Wergen | 200/6 A |
| 2004/0227727 | A1 | 11/2004 | Schena | |
| 2005/0077156 | A1 * | 4/2005 | Ushimaru et al. | 200/6 A |
| 2008/0060925 | A1 * | 3/2008 | Weber et al. | 200/341 |

FOREIGN PATENT DOCUMENTS

| | | |
|---|---|---|
| DE | 10241869 | 4/2003 |
| EP | 1167109 | 1/2002 |
| EP | 1276032 | 1/2003 |
| EP | 1650626 | 4/2006 |
| WO | 9318475 | 9/1993 |
| WO | 02089047 | 11/2002 |

OTHER PUBLICATIONS

International Search Report PCT/EP2008/002115 Dated Aug. 6, 2008.

* cited by examiner

*Primary Examiner* — Edwin A. Leon
(74) *Attorney, Agent, or Firm* — Cantor Colburn LLP

(57) ABSTRACT

The invention relates to a rotary control element comprising a control element body and a rotary button (1) mounted so as to be rotatable about at least one axis of rotation (9), wherein the control element body and the rotary button (1) cooperate such that a first associated switching function is provided by rotating the rotary button (1). The rotary control element according to the invention is characterized by the rotary button (1) being mounted so as to be displaceable relative to the control element body in at least one direction which is substantially perpendicular relative to the axis of rotation (9), with at least one additional switching function being provided.

7 Claims, 2 Drawing Sheets

CONTROL ELEMENT FOR A MOTOR VEHICLE

FIELD

The disclosure relates to a rotary control element comprising a control element body and a rotary button mounted so as to be rotatable about at least one axis of rotation, wherein the control element body and the rotary button cooperate such that a first associated switching function is provided by rotating the rotary button.

BACKGROUND

Joystick control elements are known in which a switching lever is pivotable along at least 2 preset directions or freely pivotable, wherein a switching function is executed in each case where a final position is reached (digital switching function), or wherein an associated signal is generated in proportion to the respective deflection in the two directions of deflection that are perpendicular relative to each other, said signal being used, for example, for moving a cursor on an associated display panel or display device. In the latter, the associated signals corresponding to the pivoting movement are generated by a potentiometer adjustment or by means of an optical encoder. For this purpose, the conventional joysticks have a centrally disposed operating lever mounted by means of a universal joint. Though it is possible to scale down the operating lever, however, the scaled-down versions have the drawback that they can only be found by sense of touch if looked at directly; since they cannot be grasped because they have been scaled down, they cannot be available for other switching functions, for example as pushbuttons, or at least only to a limited extent.

SUMMARY

The driver of a motor vehicle is traditionally used to execute an operation by means of a rotary switch. However, the conventional rotary switch and its available switching functions are insufficient for selecting from the ever-increasing options, which are in particular simultaneously displayed on a display panel, a display or a monitor, and to make entries. In order to provide the driver and/or operator with an easier orientation during operation, that is, an orientation that requires as little attention as possible, it would be desirable to provide a controlling option based on a rotary switch, with an improved functional capability being provided as compared with a mere rotary switch. In an exemplary embodiment of this disclosure, this is achieved by the rotary button being mounted so as to be displaceable relative to the control element body in at least one direction which is substantially perpendicular relative to the axis of rotation, with at least one additional switching function being provided. Advantageous embodiments are in each case the subject matter of the dependent claims.

The disclosure relates to a rotary control element comprising a control element body for accommodating the associated switching elements, such as, for example, optical encoders. Furthermore, a rotary button is provided. The rotary button is not limited with respect to its design. For example, it comprises a cylindrical ring and a plate-shaped cap closing off the cylindrical ring towards the operator. The ring is chromium-plated for haptics-related and/or appearance-related reasons, for example. A symbol that can be backlit and an associated light guiding element can be disposed in the rotary button. The rotary button is mounted so as to be rotatable about at least one axis of rotation, wherein the control element body and the rotary button cooperate such that a first associated regulating and/or switching function is provided by rotating the rotary button.

For example, an output signal corresponding to, optionally proportional to, the extent of rotary adjustment can be generated as a regulating function. A pure switching function is provided in another embodiment, wherein, by moving the rotary button back and forth, a switch-over is caused between an off-position and an on-position of a switching element mechanically connected with the rotary button. Apart from the rotary adjustment about the axis of rotation, a switching function can be provided by moving the rotary button in a direction parallel relative to the axis of rotation.

The rotary button is characterized in that it is mounted so as to be displaceable relative to the control element body in at least one direction which is substantially perpendicular relative to the axis of rotation, so that a parallel displacement of its axis of rotation is caused. An additional regulating and/or switching function is provided by this displacement. As was described above, an output signal corresponding to the extent of the displacement can be generated as a control parameter. In the case of a pure switching function, the displacement causes a switch-over between an off-position and an on-position of a switching element mechanically connected with the rotary button. In a particularly simple embodiment, the displacement of the rotary button is accomplished by means of a slide bearing of the rotary button relative to the control element body.

In an exemplary embodiment, the rotary button is mounted so as to be displaceable relative to the control element body in two directions which are substantially perpendicular relative to the axis of rotation, whereby the functional capability of a joystick is provided. In the simplest case, a four-way displaceability of the rotary button is thus provided.

In a an exemplary embodiment, the rotary button is freely displaceable in a plane perpendicular relative to the axis of rotation. Functional capability of a joystick means, within the meaning of the disclosure, that a switching function is provided dependent on the direction of movement. Here, a switching signal or a signal which is proportional to the actuating travel can be generated. For example, a displaceability in two perpendicular directions can be used for controlling electrical components of a vehicle, for example, for navigating in a display. In the case of free displaceability in a plane that is horizontal relative to the surface of the control element, the control element is suitable as a substitute for a mouse, i.e. as an inputting means for moving a cursor on a display device.

In order to provide the functional capability of a joystick, a universal joint is advantageously provided for the purpose of transmitting the displacement of the rotary button onto associated switching or regulating elements disposed in the control element body.

In another exemplary embodiment, the rotary button is mounted so as to be displaceable relative to the control element body by means of a roller bearing, that is, rollers that are mounted on axes. An almost frictionless displacement of the rotary button, in particular with two possible directions of displacement (four-way switch) is thus enabled in a particularly simple manner.

In another exemplary embodiment, the rotary button is mounted so as to be displaceable by means of a ball bearing. A frictionless and low-wear bearing is thus accomplished, which additionally enables a simple free displacement of the rotary button relative to the control element body.

According to an exemplary embodiment, the bearing for displacing the rotary button is disposed underneath the rotary button, preferably within a cavity defined by the rotary button. The bearing can thus advantageously be protected from dust, cleaning fluid and other dirt.

In any of the above exemplary embodiments, mechanical means may be provided, such as a spring, for resetting the rotary button into a rest position. The rest position is a position central relative to the maximum displaceability in the respective direction of displacement; advantageously, the center of the rotary button lies in the central axis and/or the rotational axis of the control element.

In an exemplary embodiment, the rotary button is provided with a substantially disc-shaped inner part, which is displaceably accommodated in a cage. A compact construction is thus achieved. Within the meaning of the disclosure, disc-shaped is to be interpreted broadly; the inner part can, for example, be star-shaped or can merely have a flat annular shape. The central inner part can be perforated and/or serve for bearing the universal joint. The substantially disc-shaped inner part is preferably mounted so as to be respectively displaceable relative to the surfaces of the cage adjoining in the direction of the axis of rotation by means of at least three, preferably evenly spaced, balls or pairs of balls. For example, 3 pairs of balls are respectively distributed evenly spaced over the circumference of the substantially disc-shaped inner part, that is, they are disposed offset by 120°, respectively, about the axis of rotation.

In order to achieve high strength and durability, the substantially disc-shaped inner part and/or the cage are manufactured from a zinc-aluminum-magnesium-copper or ZAMAK alloy. The inner part and/or the cage are, for example, manufactured by means of the zinc die-cast process.

Because of its additional functional capability, the rotary control element is advantageously used in a motor vehicle or in a household appliance ("white goods"). Since an operator is, for the most part, used to operation by means of a rotary switch, no familiarization is needed despite the additional functional capability due to the rotary switch. On the other hand, ease of use is increased because the control element has a increased functional capability as compared with a conventional rotary switch, whereby shifting one's grip to another control element becomes unnecessary. This enhanced functional capability can, for example, include the cursor control on an associated display device.

BRIEF DESCRIPTION OF THE FIGURES

The rotary button of the improved rotary control element is shown in the attached figure without limiting the disclosure thereto; in the Figures.

DETAILED DESCRIPTION

Figure 1:
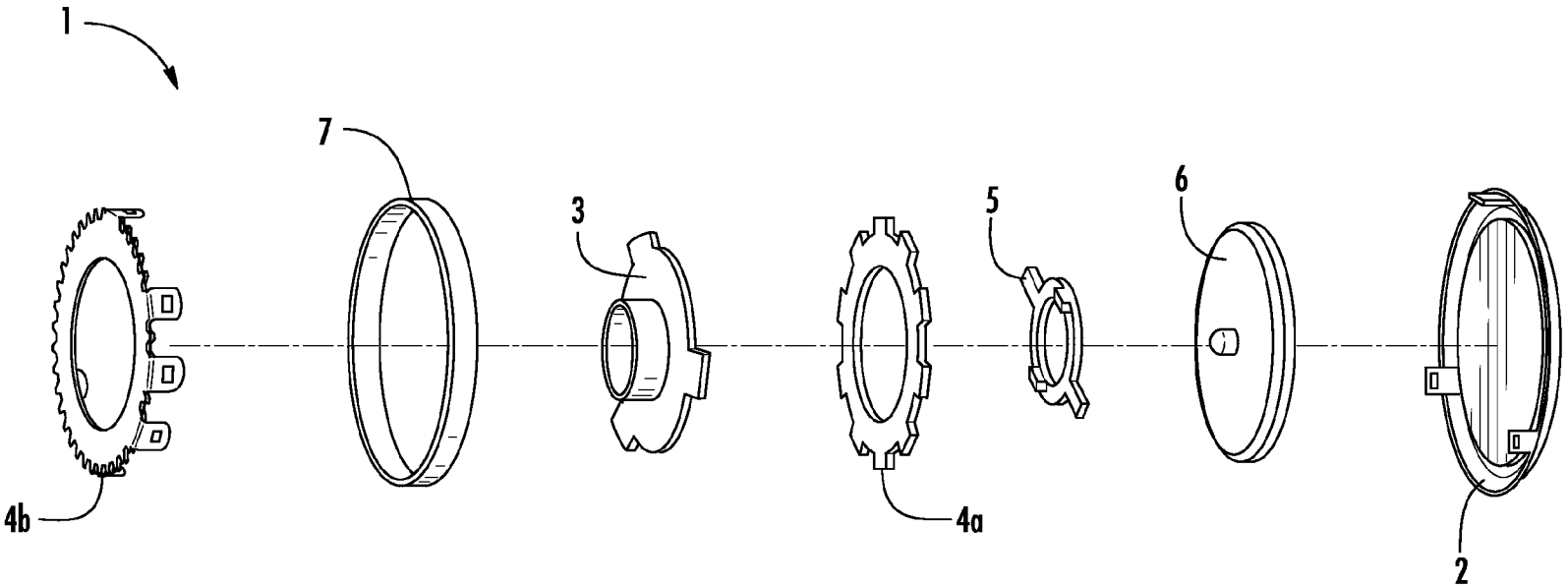
FIG. 1 shows a schematic exploded drawing of the rotary button 1.

FIG. 1 shows a portion of the rotary button 1 of the control element according to an exemplary embodiment. A plate-shaped cover 2 faces the operator, adjoined towards the side of the operator by a substantially cylindrical chrome-plated ring 6 as the handle area of the rotary button 1. The cavity defined thereby serves for accommodating a light guiding element 6 for backlighting a translucent symbol or design element disposed in the cover 2. Backlighting is effected by means of a light source not shown in detail, which is disposed in the area of the control element body not shown, which is located on the side of the rotary button 1 facing away from the operator (on the left in FIG. 1).

The cavity of the rotary button 1 serves for accommodating the bearing for displacing the rotary button 1 in a plane perpendicular to its axis of rotation, which approximately lies in the plane of the page of FIG. 1. No additional constructional height is caused despite this additional maneuverability, owing to the integration into the cavity defined by the rotary button 1. The maneuverability is achieved by a substantially disc-shaped inner part 3, which is displaceable in any direction in a cage formed by the guiding plate 4*a* and the guiding baffle 4*b*. The displacing movement of the rotary button 1 is transmitted onto the switching or regulating elements disposed in the control element body by means of the universal joint 5. Depending on the desired functional capability, technologies known from the prior art are used in the process.

Figure 2:
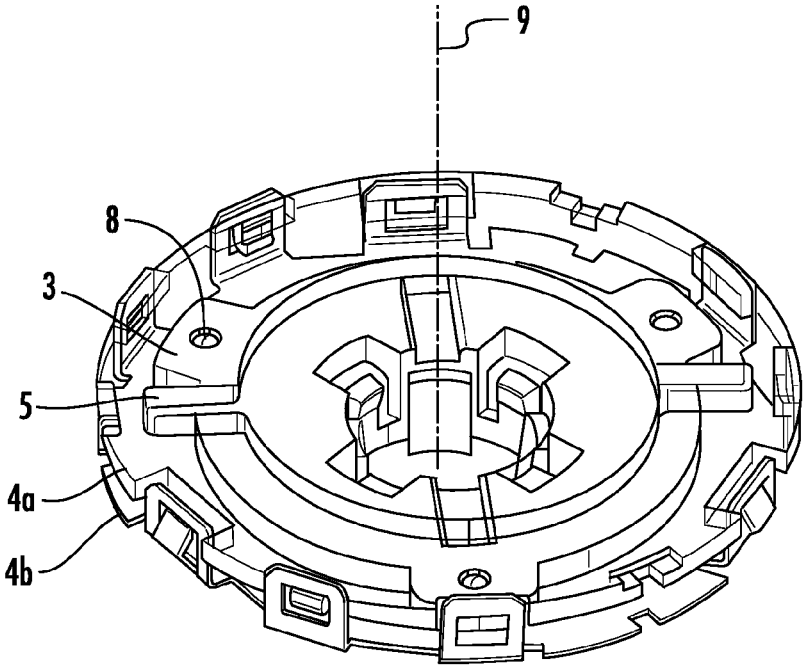
FIG. 2 is a detailed view of some assembled components from FIG. 1.
Figure 3:
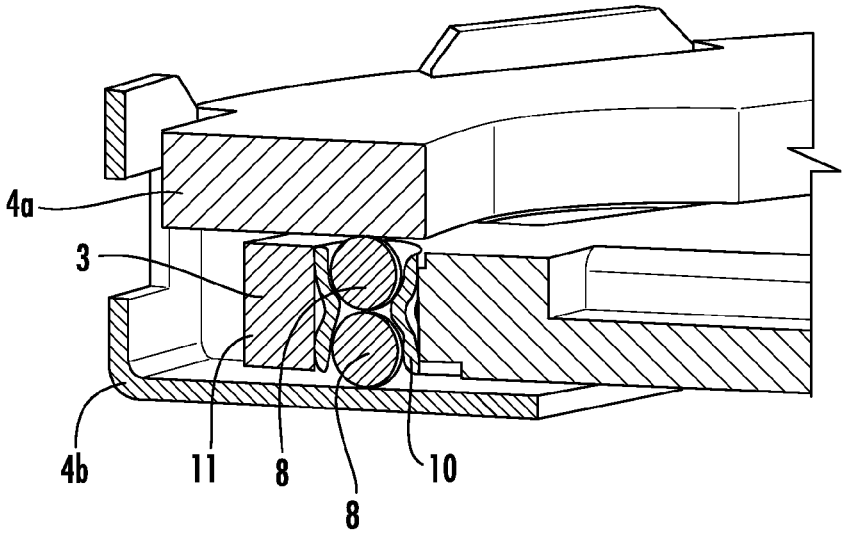
FIG. 3 is a perspective detailed view of some of the components shown in FIG. 1.

The arrangement of the components 3, 4*a*, 4*b* and 5 of the rotary button 1 are shown in an assembled state in FIG. 2. The guiding plate 4*a* and the guiding baffle 4*b* are latched by means of snap hooks. The cage thus formed serves the purpose of accommodating the substantially disc-shaped inner part 3. Its almost wear-less and frictionless displaceability is achieved by three pairs 8 of balls, which are shown in detail in FIG. 3 and are disposed respectively offset by 120° around the axis of rotation. The inner part 3 also serves the purpose of bearing the universal joint 5, by means of which the displacement is mechanically converted into an electrical switching or regulating function. Other latch eyelets of the guiding baffle 4*b* serve for latching into latches provided on the chromium-plateable ring 7.

The rotary button 1 can be rotated about its central axis 9 and can be displaced in any direction by means of the latched guiding parts 4*a*, 4*b*. In this case, displacement takes place in a plane perpendicular relative to the central axis 9, which plane lies substantially in the same plane as the cover 2, so that for the operator, the result is a substantially horizontal displaceability if the control element is disposed in a center console of a motor vehicle.

The balls 8 in the associated ball accommodation 10 move relative to each other and in different directions, with the balls 8 adjoining each other and the guiding parts 4*a*, 4*b*. The displaceability of the guiding parts 4*a*, 4*b* over the fixed inner part 3 is limited by the outer ends 11 of the inner part 3.

The invention claimed is:

1. Rotary control element, comprising a control element body and a rotary button displaceably mounted by means of ball bearings, wherein the bearing for displacing the rotary button is disposed underneath the rotary button, preferably within a cavity defined by the rotary button, so as to be rotatable about at least one axis of rotation, the rotary button is provided with a substantially disc-shaped inner part, which is displaceably accommodated in a cage, wherein the substantially disc-shaped inner part is mounted so as to be respectively displaceable relative to the surfaces of the cage adjoining in the direction of the axis of rotation by means of at least three, preferably evenly spaced, balls or pairs of balls, wherein the control element body and the rotary button cooperate such that a first associated switching function is provided by rotating the rotary button, wherein the rotary button is mounted so as to be displaceable relative to the control element body in at least one direction which is substantially perpendicular relative to the axis of rotation, with at least one additional switching function being provided.

2. Rotary control element according to claim 1, wherein the rotary button is mounted so as to be displaceable relative to the control element body in two directions which are substantially perpendicular relative to the axis of rotation, preferably freely displaceable in a plane perpendicular relative to the axis of rotation, so that the functional capability of a joystick is provided.

3. Rotary control element according to claim 2, wherein, in order to provide the functional capability of the joystick, a universal joint is provided for transmitting the displacement of the rotary button onto associated switching or regulating elements of the control element body.

4. Rotary control element according to claim 1, wherein the rotary button is displaceably mounted by means of roller bearings.

5. Rotary control element according to claim 1, wherein mechanical means for resetting the rotary button into a rest position in the displacement direction of the rotary button are provided.

6. Rotary control element according to claim 1, wherein the substantially disc-shaped inner part and/or the cage are manufactured from a zinc-aluminum-magnesium-copper alloy.

7. Motor vehicle, comprising a rotary control element according to claim 1.

* * * * *